United States Patent [19]

Pinkerton

[11] Patent Number: 5,044,889

[45] Date of Patent: Sep. 3, 1991

[54] PHASE ADJUSTABLE METERING PUMP, AND METHOD OF ADJUSTING THE FLOW RATE THEREOF

[76] Inventor: Dennis Pinkerton, P.O. Box 179, Oyster Bay, N.Y. 11771

[21] Appl. No.: 523,981

[22] Filed: May 16, 1990

[51] Int. Cl.[5] ..... F04B 7/06

[52] U.S. Cl. ..... 417/53; 141/116; 417/494; 417/499; 417/500

[58] Field of Search ..... 417/53, 492, 494, 499, 417/500; 141/116, 119

[56] References Cited

U.S. PATENT DOCUMENTS

| | | | |
|---|---|---|---|
| 1,501,758 | 7/1924 | Drees | 417/500 |
| 2,070,203 | 2/1937 | Gregg | 417/499 |
| 2,107,987 | 2/1938 | Johnson | 141/116 X |
| 2,775,210 | 12/1956 | Buchmann | 417/499 X |
| 3,168,872 | 2/1965 | Pinkerton | 417/500 X |
| 3,257,953 | 6/1966 | Pinkerton . | |
| 4,008,003 | 2/1977 | Pinkerton . | |
| 4,575,317 | 3/1986 | Lindner . | |

*Primary Examiner*—Robert G. Nilson

*Attorney, Agent, or Firm*—Hoffmann & Baron

[57] ABSTRACT

A valveless, positive displacement metering pump is provided by the invention. Such a pump includes a housing, a working chamber within the housing, a piston within the working chamber, the piston including a duct defined by a portion of its outer surface, one or more inflow ports communicating with the working chamber, one or more outflow ports communicating with the working chamber, and a drive cylinder for simultaneously rotating the piston and causing it to move in back and forth strokes within the working chamber. The housing is rotatable with respect to the piston to adjust the timing of the fluid communication between the duct and the inflow and outflow ports, respectively. Such adjustments in timing allow the flow rate of the pump to be fine tuned, and allow each port to experience a partial suction as well as a partial discharge. A method for adjusting the flow rate of a valveless, positive displacement metering pump is also provided which includes adjusting the phases at which the piston duct communicates with each of the ports of the pump.

18 Claims, 6 Drawing Sheets

PHASE ADJUSTABLE METERING PUMP, AND METHOD OF ADJUSTING THE FLOW RATE THEREOF

FIELD OF THE INVENTION

The field of the invention relates to metering pumps for pumping relatively precise volumes of fluid.

BRIEF DESCRIPTION OF THE PRIOR ART

Valveless, positive displacement metering pumps have been successfully employed in many applications where safe and accurate handling of fluids is required. The valveless pumping function is accomplished by the synchronous rotation and reciprocation of a piston in a precisely mated cylinder bore. One pressure and one suction stroke are completed per cycle. A duct (flat portion) on the piston connects a pair of cylinder ports alternately with the pumping chamber, i.e. one port on the pressure portion of the pumping cycle and the other on the suction cycle. The mechanically precise, free of random closure variation valving is performed by the piston duct motion. A pump head module containing the piston and cylinder is mounted in a manner that permits it to be swiveled angularly with respect to the rotating drive member. The degree of angle controls stroke length and in turn flow rate. The direction of the angle controls flow direction. This type of pump has been found to perform accurate transfers of both gaseous and liquid fluids.

In some applications, it is necessary to provide extremely precise flow rates from inflow and/or outflow ports of a metering pump. This is conventionally accomplished by carefully adjusting the angular orientation of the pump head module as described above.

In applications where a suspension is to be pumped, it is often desirable to continuously agitate the suspension. This is conventionally accomplished through shaking or stirring means.

It may also be desirable to provide backflow through the lines connected to a metering pump in order to clean any filters therein. This has been accomplished by reversing the flow of the pump entirely or disconnecting the line and subjecting it to a flow opposite to the direction of original flow.

SUMMARY OF THE INVENTION

It is an object of the invention to provide a valveless, positive displacement metering pump including means for adjusting the timing of the stroke of a piston with respect to inflow or outflow ports communicating with a cylinder which houses the piston.

It is another object of the invention to provide a valveless, positive displacement metering pump capable of dispensing fluids at precise flow rates.

A still further object of the invention is to provide a valveless, positive displacement pump which is capable of providing negative pressure at a discharge port in order to prevent a hanging drop or fluid string from forming at the port at the conclusion of the pumping phase.

A still further object of the invention is to provide a valveless, positive displacement pump including a housing which maintains a pump head module at a fixed angular position with respect to a rotating drive member.

In accordance with these and other objects of the invention, a valveless, positive displacement metering pump is provided which includes a housing; a working chamber within the housing; a piston within said working chamber, the piston including a duct defined by its outer surface; a first port extending within the housing and communicating with the working chamber at a first radial position; a second port extending within the housing and communicating with the working chamber at a second radial position; means for causing the piston to move in back and forth strokes along an axis within the working chamber; means for rotating said piston; the piston being positioned such that the duct is in sequential fluid communication with the first and second ports, respectively, as the piston is oscillated and rotated within the working chamber; and means for rotating the housing with respect to the piston, thereby adjusting the timing of the fluid communication between the duct and the first and second ports, respectively, as the piston rotates within the working chamber.

By rotating the housing in the above-described manner, one or more of the ports may be exposed to a portion (or all) of the forward piston movement as well as a portion (or all) of the backward piston movement. The net flow through each port may accordingly be adjusted to provide very accurate flow rates by controlling when each port communicates with the duct. In addition, by causing limited backflow through a port otherwise used for inflow, the source of fluid connected to the inflow port may be agitated. This is useful if the source contains a suspension. It is also useful if there are any filters between the fluid source and inflow port.

The ability to adjust the timing of the pump in the above-described manner also allows the construction of a particularly inexpensive pump wherein the pump head module is permanently maintained at a selected angle with respect to the rotating drive member for the piston. The phase adjustability of the pumping mechanism compensates for parts of the pump which may be out of tolerance.

DETAILED DESCRIPTION OF THE INVENTION

A valveless, positive displacement metering pump 10 is disclosed which includes three ports, two of which are used at any one time either as inlet or outlet ports while the other is used in an opposite manner. The pump may include as few as two ports if only one inflow port and one outflow port are necessary or desired.

Figure 2:
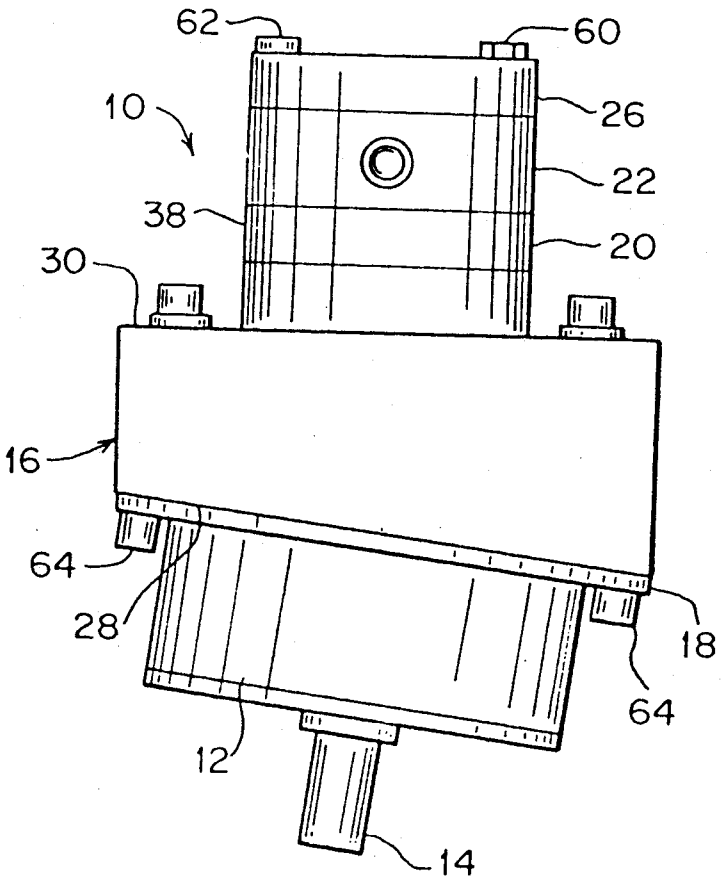
FIG. 2 is a top plan view thereof.
Figure 1:
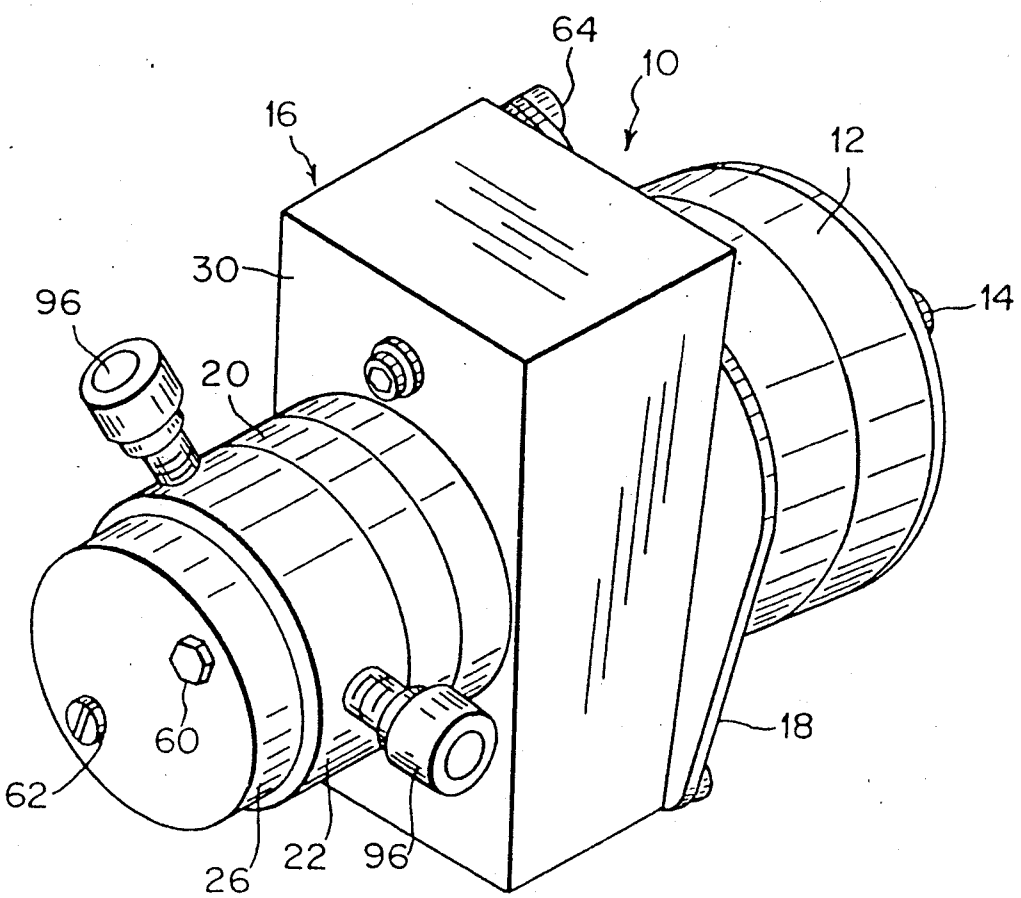
FIG. 1 is a front perspective view of a valveless, positive displacement metering pump according to the invention.
Figure 3:
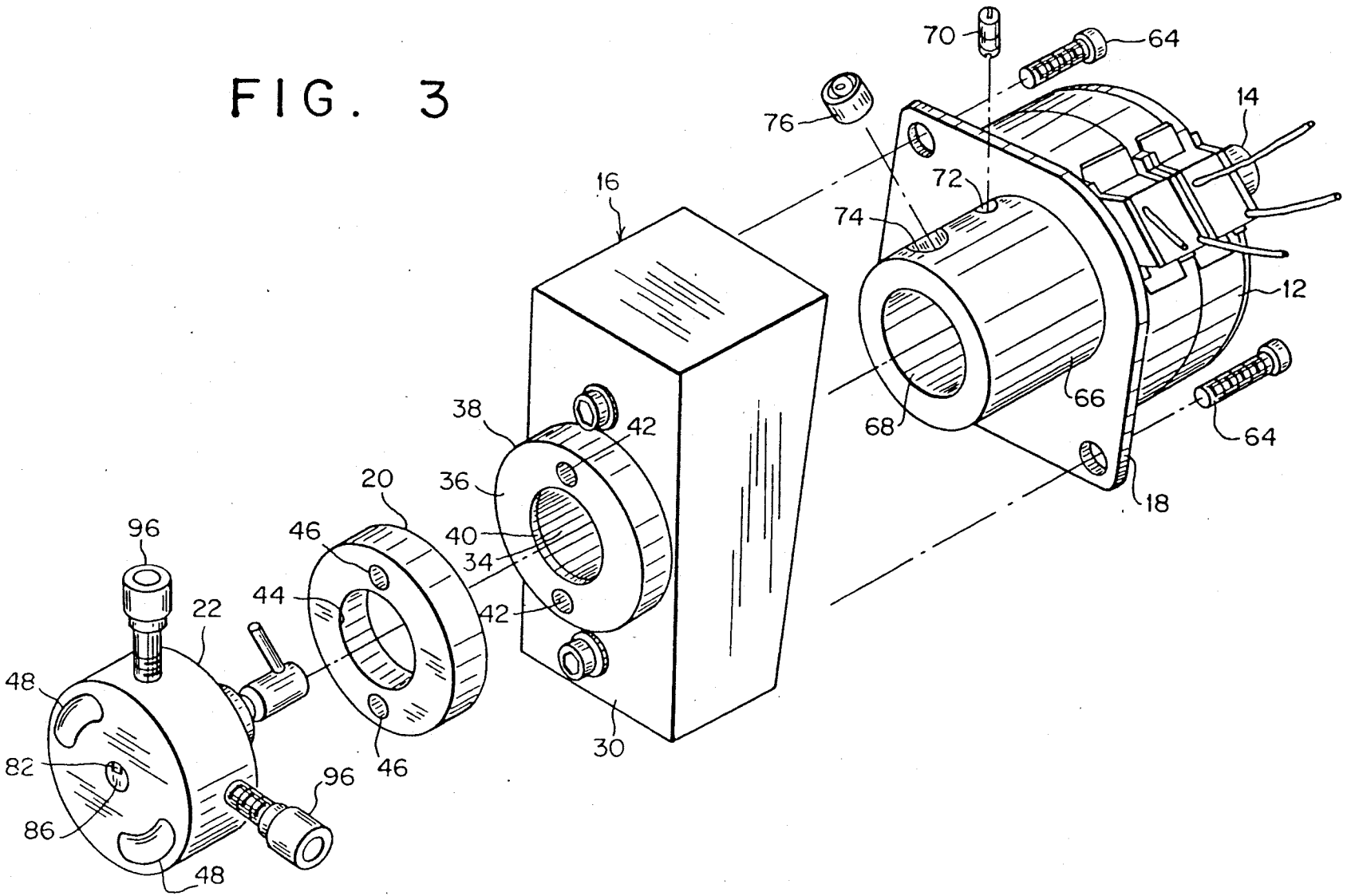
FIG. 3 is an exploded, front perspective view thereof.
Figure 5:
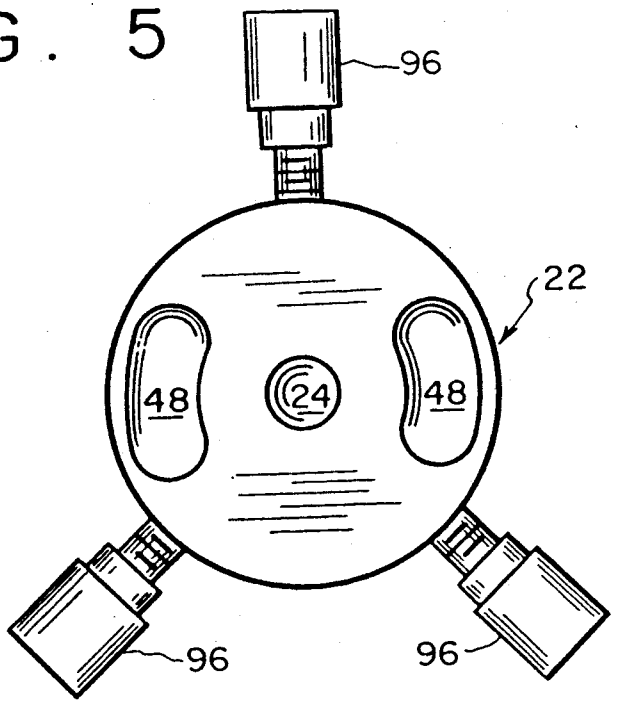
FIG. 5 is a front perspective view of a housing for a pump working chamber.

Referring to FIGS. 1-3, the pump 10 includes drive means such as a motor 12 including a drive shaft 14, an integral support in the form of a block 16, a flat, metal plate 18 secured to the motor housing and the block 16, a cylindrical spacer 20 adjoining the block 16, a cylindrical housing 22 which includes a cylindrical working chamber 24 (FIGS. 5-6), and a cylindrical closure 26.

The block 16 is made from any suitable metal or plastic material which is usable in the intended environment for the pump. The block includes a pair of converging surfaces 28, 30. The pump head module, which comprises the spacer 20, housing 22 and closure 26, is mounted to a cylindrical projection 38 extending from the front surface 30 of the block. This module accordingly extends at an oblique angle with respect to the axis defined by the motor drive shaft 14. The module and cylindrical projection both extend substantially perpendicular with respect to the plane defined by the front surface 30.

The block 16 includes a large, cylindrical bore 34 which extends nearly completely through the block and terminates at a front wall 36 of the cylindrical projection 38. A smaller bore 40 extends through this wall 36. Two small, threaded bores 42 extend at least partially through the projection 38.

The spacer 20 includes an axial bore 44 having about the same diameter as the above-mentioned smaller bore 40 within the projection 38, and a pair of unthreaded bores 46 extending therethrough. This axial bore 44 is aligned with the bore 40 while the two smaller bores 46 are aligned, respectively, with the two small, threaded bores 42 within the projection 38.

Figure 4:
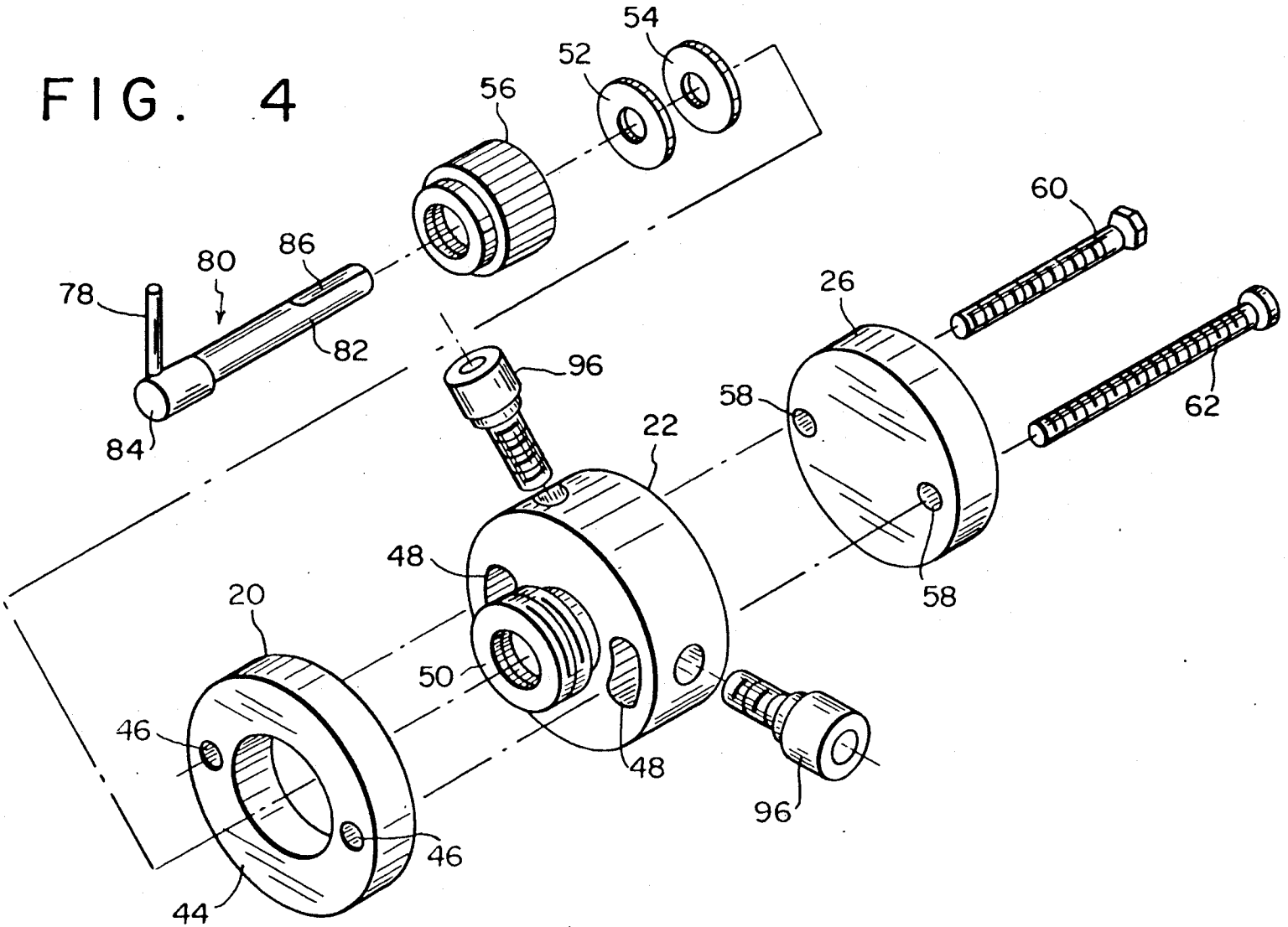
FIG. 4 is an exploded, rear perspective view of several elements of said pump.

The housing 22 for the working chamber 24 includes a pair of oblong openings 48 aligned with the bores 46 extending through the spacer. It is preferably made from a dimensionally stable ceramic material, a rigid polymer such as carbon fiber reinforced polyphenylinesulfide, which is sold, for example, under the trade name RYTON, or a suitable metal. A threaded, cylindrical projection 50, formed integrally with the housing 22, extends rearwardly therefrom. A pair of washers 52, 54, as shown in FIG. 4, adjoin the flat, rear face of the projection 50, and are maintained in place by a gland nut 56.

The closure 26 includes a pair of bores 58 extending therethrough. These bores 58 are aligned with the openings 48 extending through the housing 22 of the working chamber 24 The closure includes a flat rear surface which adjoins the flat front surface of the housing 22. It accordingly seals one end of the working chamber 24. As an alternative, the housing and closure could be constructed as one piece, thereby obviating the need for a separate closure. A pair of screws 60, 62 extend through the pairs of bores 58, 48, 46, respectively, and are threadably secured to the block 16 by means of the threaded bores 42. The closure 26, housing 22, spacer 20 and block 16 are secured, respectively, to each other by this pair of screws 60, 62. Each of these elements is shown as having substantially the same outside diameters.

As discussed above, the flat plate 18 is secured to the motor housing. A pair of screws 64 secure the plate 18 to the block 16. As shown in FIG. 3, the front portion of the motor drive shaft 14 is secured to a drive cylinder 66. The cylinder includes a cylindrical chamber 68 having an open front end. The rear end of the chamber is closed by a wall (not shown) through which the front portion of the drive shaft 14 extends. A lock screw 70 extends through a threaded bore 72 which extends through this wall, and bears against the drive shaft 14. The drive cylinder 66 accordingly rotates with the drive shaft when the motor 12 is actuated.

Figure 9:
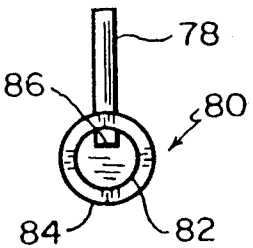
FIG. 9 is a front elevation view thereof.
Figure 8:
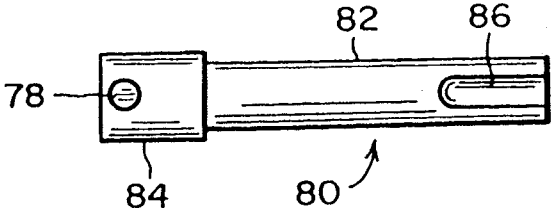
FIG. 8 is a side elevation view of a piston.
Figure 7:
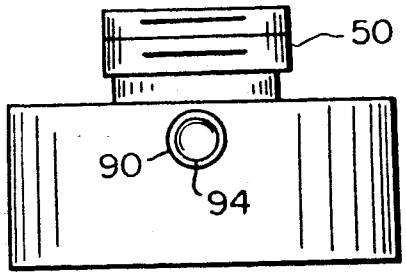
FIG. 7 is a top plan view thereof.

A second, relatively larger bore 74 extends through the drive cylinder 66 and communicates with the chamber 68 therein. A ball and socket fitting 76 is positioned within this bore 74. The ball member of this fitting includes a passage extending therethrough for receiving a connecting rod 78 of a piston assembly 80. The piston assembly, which is best shown in FIGS. 4, 8 and 9, includes a cylindrical piston member 82, a cap 84 secured to the rear end of the piston member, the connecting rod 78 extending through the cap and piston member. The front end of the piston member 82 includes a longitudinal duct 86 extending from the end surface thereof to a selected point behind this end surface. The duct is shown in the form of a channel including a flat bottom wall and a pair of side walls extending perpendicularly therefrom. A V-shaped channel would provide generally equivalent operating results, as would a duct in the form of a flat.

Referring now to FIGS. 4-7, the housing 22 for the working chamber 24 is constructed so that the piston member 82 can rotate and reciprocate freely within the working chamber 24. The front end of the piston member is accordingly chamfered to facilitate such reciprocation. The clearance between the piston member and wall of the working chamber may be about one ten thousandth of an inch when used for pumping aqueous solutions. The maximum length of the stroke of the piston member is such that the duct 86 is always entirely within the working chamber 24, and is substantially always in fluid communication with at least one of the three passages 88, 90 communicating with the working chamber.

In the embodiment of the invention depicted in the drawings, three passages adjoin the working chamber. The diameters of the passages, axial positions of the passages, and the width of the duct 86 are all important in insuring that the proper flow rates into and out of the passages will be obtained.

Figure 6:
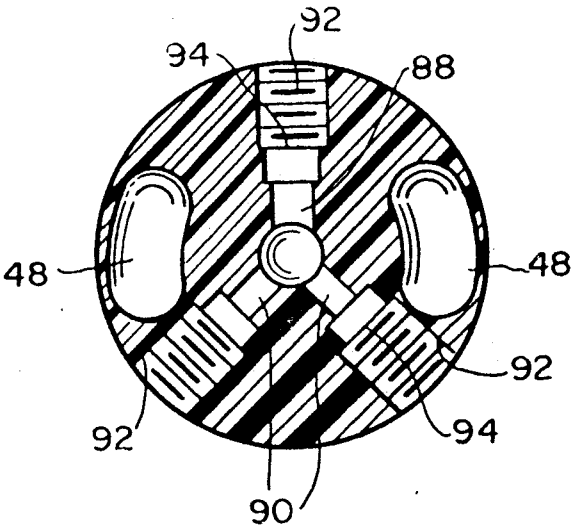
FIG. 6 is a sectional, front elevation view thereof.

As best shown in FIG. 6, one relatively large diameter passage 88 extends along a reference axis which is substantially vertical. Two smaller diameter passages 90 each extend at a forty-five degree angle with respect to the reference axis, and are therefore ninety degrees apart. The diameters of the passages would, of course, be adjusted if additional or fewer passages were employed.

In a particular embodiment of the invention, discussed here solely for explanatory purposes, a piston member 82 having a quarter inch diameter is employed. The duct 86 within the piston member has a length of about three eighths of an inch. The depth and width of the duct are about 0.102 inches. The channel accordingly traverses an axial distance of roughly about forty-five degrees. The relatively large passage 88 has a diameter of about 0.228 inches while each of the smaller passages 90 in fluid communication with the working chamber 24 have diameters of about 0.089 inches. The axes of the three passages are substantially coplanar so that each will communicate with the duct 86 for a selected length of time as the piston assembly is rotated.

Each passage communicates with a threaded bore 92 which extends between the outer surface of the housing 22 and an annular seating surface 94. A tube (not shown) having a conical fitting (not shown) secured to its end may be inserted with one of the threaded bores until the conical fitting contacts the seating surface 94. The conical fitting is maintained in place by a lock screw 96 which is engaged by the threaded bore. The lock screw presses the conical fitting against the seating surface 94 to provide a fluid-tight seal.

In operation, the piston assembly is caused to reciprocate upon rotation of the motor shaft 14. The rotation of the motor shaft causes rotation of the cylinder 66 secured thereto. The piston assembly 80, being connected to the cylinder 66 by the fitting 76 and connecting rod 78, rotates about its axis at the same time it is caused to reciprocate. The angular orientation of the front surface 30 of the block, and therefore the working chamber 24, with respect to the axis of the drive cylinder 66 within the block 16, causes the rotation of the fitting 76, and therefore the piston assembly to be eccentric with respect to the working chamber. This causes the combined rotational and reciprocal motion of the piston member 82 within the working chamber 24.

The housing 22 is oriented with respect to the drive cylinder 66 such that the piston member 82 will be moving in a first axial direction as the duct 86 communicates with the port communicating with the largest 88 of the three passages and in an opposite direction as it moves into communication with the ports in the working chamber communicating with the smaller passages 90. For example, if the relatively large passage 88 were to be used as an inflow passage, and the smaller passages were to be used for fluid outflow, the piston assembly would move inwardly as the duct communicates with the larger passage. Suction would be created, and fluid would be drawn into the channel 86 and working chamber. The ports for the smaller passages 90 would be sealed by the cylindrical outer surface of the piston member 82 during this phase. As the piston assembly would continue to rotate, it would eventually start moving in the opposite axial direction, i.e. towards the closure 26. The duct would communicate with one of the smaller passages, and then the other, during this pumping phase, thereby moving fluid from the working chamber 24, through the duct, and into the respective passages 90. The larger passage 88 would be closed at this time.

In order to avoid undue strain upon the pump, the length and width of the duct 86, and the diameters and positions of the three passages 88, 90 are constructed such that the duct is virtually always in fluid communication with one of the three passages regardless of the axial or rotational position of the piston assembly 80. The stroke of the piston assembly should be less than the length of the duct.

While the pump shown in the figures includes three passages which communicate with the duct and working chamber, it will be appreciated that fewer or additional passages may be provided at different radial positions to provide different inflow or outflow capabilities. The diameters of the respective passages may also be modified if unequal flows are desired.

In accordance with the pump as illustrated, the relatively large passage 88 is in fluid communication with the duct over about one hundred eighty degrees of rotation of the piston assembly 80. The second and third passages, which have the same diameter, each communicate with the duct over about ninety degrees of rotation apiece. The piston member 82 moves in one axial direction as the duct communicates with the first passage 88. It moves in the opposite axial direction when communicating with the other two passages 90. Both the passages and the duct form relatively sharp corners with respect to the working chamber to insure the precise control of fluid flow within the pump.

The block 16 is formed as an integral, immovable mass which maintains the pump head module at a preselected angle with respect to the drive cylinder 66. The stroke of the piston is determined by this preselected angle. A hinged block may alternatively be employed to allow the user to adjust the angle of the pump head module with respect to the drive cylinder.

An important feature of the present invention is the ability to adjust the timing of the piston with respect to the ports within the working chamber. This is accomplished by maintaining the piston assembly 80 in a fixed position while turning the housing 22 for the working chamber 24 about its axis, or by operating the pump as the housing is rotated so that relative movement of the housing with respect to the piston is obtained.

In order to turn the housing 22, the screws 60, 62 holding the closure 26, housing 22 and spacer 20 to the block 16 are first loosened. The oblong openings 48 in the housing, through which the screws 60, 62 extend, allow the housing, and thereby the working chamber 24, to be rotated a total of about thirty degrees about their common axis. Such rotation with respect to the piston assembly 80 will affect the piston movement profile with respect to the working chamber port locations. In other words, the duct 86 will move into fluid communication with the respective ports at different axial positions and while moving in at least partially different axial directions as compared with the positions and direction prior to housing rotation.

Figure 10:
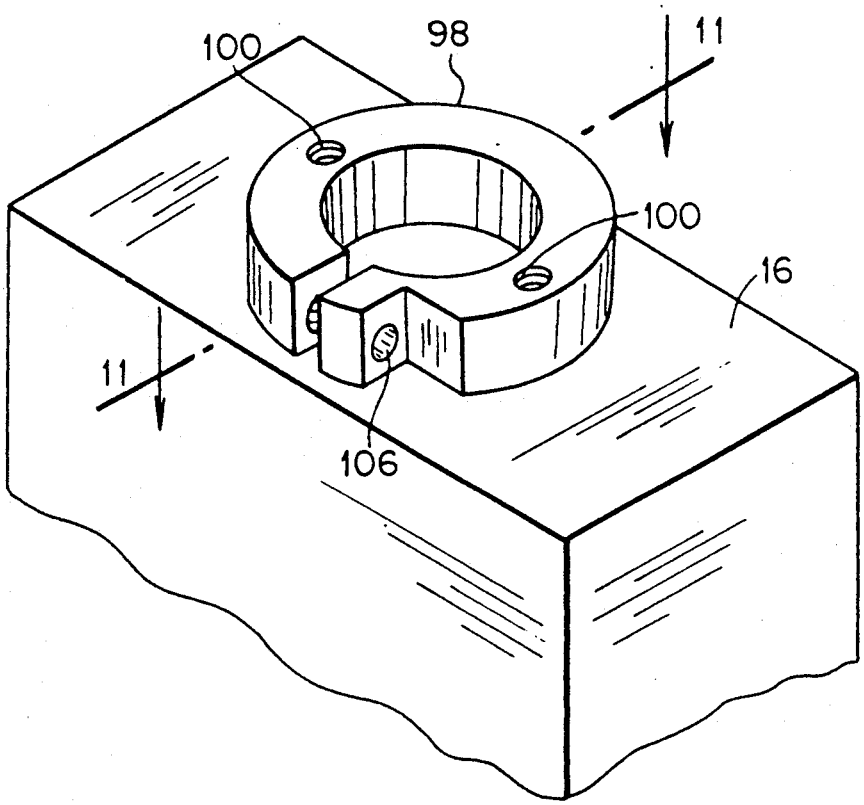
FIG. 10 is a top perspective view of a portion of a metering pump including an adjustable collar.
Figure 11:
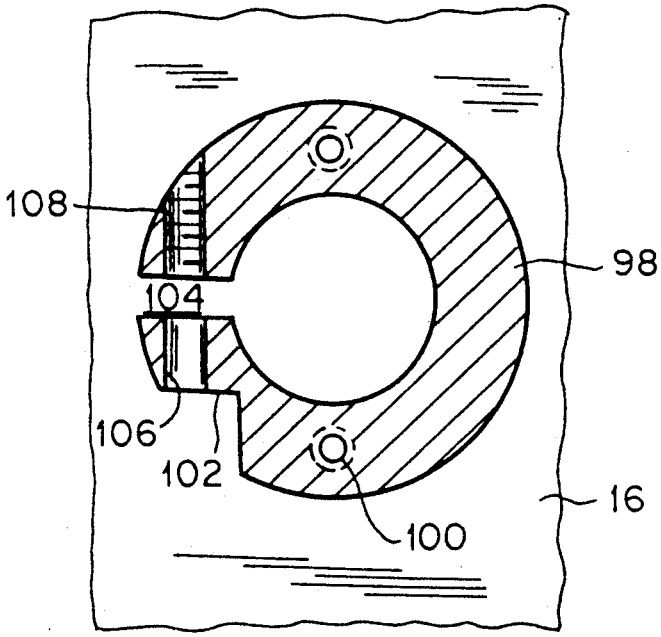
FIG. 11 is a sectional view thereof taken along line 11—11 of FIG. 10.

Referring to FIGS. 10–11, a collar 98 may be secured to the block 16 as shown or to the projection 38. The collar 98 includes a pair of small, threaded openings 100 aligned with the corresponding openings 48 in the housing 22 and other components of the pump head module. It also includes a notch 102. The collar is broken, as shown at 104, to allow the collar to be employed as a clamp. An unthreaded bore 106 extends between the notch 102 and one end of the collar. A threaded bore 108 extends through an opposing portion of the collar and is aligned with the unthreaded bore. A screw (not shown) may be inserted within the respective bores 106, 108. Turning the screw causes the break 104 in the collar to either open or close. The collar accordingly can function as a releasable clamp.

When the assembly as shown in FIGS. 10–11 is employed, the gland nut 56 is arranged such that it extends within the collar 98. When the collar is tightened, the gland nut 56, and the housing 22 to which it is connected, are maintained in fixed positions as the collar engages the gland nut. Upon loosening the collar such that the break 104 opens sufficiently, the gland nut and housing can be rotated with respect to the piston, thereby changing the timing of the pump.

The housing 22 may be secured in a number of ways without using a collar. The frictional engagement among the housing and the closure 26 and spacer 20 help to maintain the housing in a fixed position when timing adjustments are not being made. Mechanical engagement means, such as a set screw, could also be employed.

There are a number of practical advantages to the phase adjustability of the above-described pump. One such advantage is that it can be used to compensate for portions of the pump which may not be in the necessary tolerance ranges to provide the proper flows into and out of the respective ports. For example, if the block is constructed as shown in FIGS. 1–3, it is difficult to insure that the precise flow rates which are ordinarily required of valveless, positive displacement metering pumps will be obtained. Rotation of the housing 22 as described above causes the flow rate at each port to be adjusted. Small adjustments are usually all that are necessary to compensate for problems caused by variations from tolerances.

The timing of the pump may be adjusted such that one or more of the ports are exposed to the duct 86 as the piston moves in a first and then a second axial direction. If the flow from an outflow port needs to be reduced, the housing 22 may be turned to expose it to the duct 86 while the piston member 82 is still moving in the backward or suction direction, just prior to its reversing direction to pump fluid into the port. The volume pumped through this outflow port is accordingly reduced by the volume which ordinarily would have been pumped had the piston been moving forwardly the whole time the outflow port had been exposed to the duct 86.

Figure 12:
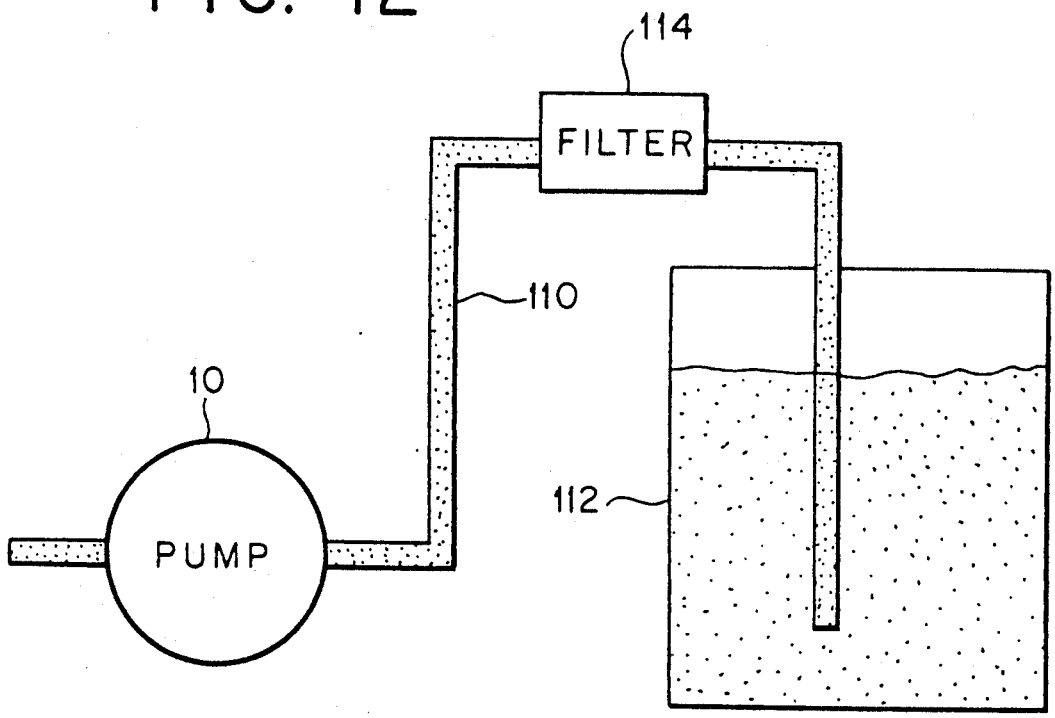
FIG. 12 is a schematical illustration of a pump as used in a particular environment for pumping a suspension.

An inflow port may also be exposed to the duct 86 as the piston member moves a short distance in the forward direction followed by a longer distance in the rearward (suction) direction. When moving in the forward direction, backflow is created in the inflow line leading to the pump. Referring to FIG. 12, the inflow line 110 may be connected between the pump 10 and a vessel 112 containing a suspension. A filter 114 may be provided within the line to prevent particles greater than a selected size from entering the pump 10. Backflow created in the line by exposing an inflow port to the compression stroke of the piston member 82 for a short period of time helps to clean the filter and agitate the suspension within the vessel 112.

If a viscous fluid is to be pumped, it is preferred that suction be applied at the outflow passage(s) of the pump at the end of each discharge portion of the piston stroke. This prevents a hanging drop or string from forming at the discharge end of an outflow line 116 which transfers the viscous fluid from the pump to a container.

While phase adjustment of the valveless, positive displacement metering pump 10 is preferably accomplished by rotating the housing 22 with respect to the piston 82, an alternative procedure would be to change the orientation of the connecting rod 78 with respect to the duct 8 from the substantially perpendicular relationship shown in FIG. 4. The advantage of rotating the housing with respect to the piston is that it may be done while the pump is still running. The orientation of the connecting rod 78 can be changed only when the pump is stopped.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A valveless, positive displacement metering pump comprising:

a housing;

a working chamber within said housing;

a piston within said working chamber, said piston including a duct defined by an outer surface portion thereof;

a first port extending into said housing and communicating with said working chamber at a first radial position;

a second port extending into said housing and communicating with said working chamber at a second radial position;

means for causing said piston to move in back and forth strokes along an axis within said working chamber;

means for rotating said piston as it moves back and forth within said working chamber;

said piston being positioned such that said duct is in sequential fluid communication with said first and second ports, respectively, as said piston is oscillated and rotated within said working chamber; and means for adjusting the timing of the fluid communication between said duct and said first and second ports, respectively, as said piston rotates and moves back and forth within said working chamber, said means for adjusting the timing including means for rotatably mounting said housing with respect to said piston.

2. A pump as described in claim 1 wherein at least one of said ports is positioned such that it is maintained in fluid communication with said duct as said piston is moved through at least part of both of said back and forth strokes within said working chamber.

3. A pump as described in claim 2 wherein said at least one of said ports is positioned such that it is maintained in fluid communication with said duct for only a minority of one of said back and forth strokes of said piston.

4. A pump as described in claim 3 wherein said at least one of said ports is positioned such that it is maintained in fluid communication with said duct for a majority portion of the other of said back and forth strokes of said piston.

5. A pump as described in claim 1 wherein said housing is rotatably mounted to a support.

6. A pump as described in claim 5 wherein said housing includes a pair of openings extending therein, a pair of elongate connecting means extending, respectively, through said openings and secured to said support, the housing walls defining said openings defining stops for engaging said connecting means upon rotation of said housing with respect to said support a selected number of degrees about an axis.

7. A pump as defined in claim 5 including means for limiting the rotatability of said housing with respect to said support.

8. A pump as defined in claim 7 including means for maintaining said housing in a fixed position.

9. A pump as defined in claim 8 including a drive cylinder rotatably mounted within said support, and means for pivotably connecting said piston to said drive cylinder.

10. A pump as defined in claim 9 wherein said drive cylinder includes an axis, said piston includes an axis, the axis of said piston extending at an angle with respect to the axis of said drive cylinder.

11. A pump as defined in claim 10 including means for rotating said drive cylinder.

12. A method of adjusting the flow rate into or out of a valveless, positive displacement metering pump of the type including a housing, a cylindrical working chamber within said housing, a piston rotatably and slidably positioned within said working chamber, said piston including a duct defined by an outer surface portion of said piston, a first port extending into said housing and communicating with said working chamber at a first radial position, a second port extending into said housing and communicating with said working chamber at a second radial position, means for causing said piston to move in back and forth strokes along an axis within said working chamber, and means for rotating said piston within said working chamber as said piston moves back and forth within said working chamber such that said duct is in sequential communication with said first and second ports, respectively, comprising:

changing the relative positions of said working chamber and said piston such that said duct communicates with each of said ports during different phases of the rotational and back and forth movements of said piston within said working chamber, the step of changing the relative positions of said working chamber and said piston including the step of rotating said housing from a first position to a second position with respect to said piston such that said duct communicates with each of said ports during different phases of said rotational and back and forth movements of said piston in said second position than in said first position.

13. A method as defined in claim 12 wherein said step of changing the relative positions of said working chamber and said piston causes at least one of said ports to communicate with said duct during at least part of both the back and forth strokes of said piston within said working chamber.

14. A method as defined in claim 12 wherein at least one of said ports communicates with said duct during at least part of both back and forth strokes of said piston within said working chamber when said housing is in said second position.

15. A method as defined in claim 14 wherein said at least one of said ports communicates with said duct for a much greater period of time while said piston is moving in one of said back and forth strokes than the other of said back and forth strokes when said housing is in said second position.

16. A method as defined in claim 12 wherein said housing is rotatably mounted to a support, and Wherein said step of rotating said housing with respect to said piston includes rotating said housing with respect to said support.

17. A method as defined in claim 12 wherein said step of changing the relative positions of said working chamber and said piston is conducted as said pump is operating.

18. A valveless, positive displacement metering pump comprising:

a support;

a drive cylinder rotatably mounted within said support, said drive cylinder including an axis of rotation;

a housing secured to said support;

a cylindrical working chamber defined within said housing, said working chamber including an axis;

a piston positioned within said working chamber, said piston including a duct defined by a portion of an outer surface of said piston;

means for pivotably connecting said piston to said drive cylinder;

a first port extending within said housing and in fluid communication with said working chamber;

a second port extending within said housing and in fluid communication with said working chamber;

means for rotating said housing with respect to said support and about the axis of said working chamber; and means for securing said housing in a selected rotational position with respect to said support;

said housing being secured to said support in a fixed, permanently immovable angular position with respct to said support such that the axis of said working chamber is at a fixed, permanently immovable angle with respect to the axis of rotation of said drive cylinder.

* * * * *